US005330293A

United States Patent [19]

White et al.

[11] Patent Number: 5,330,293

[45] Date of Patent: Jul. 19, 1994

[54] FLOATING PRODUCTION AND STORAGE FACILITY

[75] Inventors: Charles N. White; John A. Mercier, both of Houston, Tex.

[73] Assignee: Conoco Inc., Ponca City, Okla.

[21] Appl. No.: 23,507

[22] Filed: Feb. 26, 1993

[51] Int. Cl.[5] ..... B63B 35/44

[52] U.S. Cl. ..... 405/211; 405/224; 405/224.2

[58] Field of Search ..... 405/195.1, 202, 211, 405/217, 223.1, 224, 224.2

[56] References Cited

U.S. PATENT DOCUMENTS

| | | | |
|---|---|---|---|
| 3,111,692 | 11/1963 | Cox . | |
| 3,256,936 | 6/1966 | Johnson et al. . | |
| 3,327,780 | 6/1967 | Knapp et al. . | |
| 3,407,768 | 10/1968 | Graham . | |
| 3,461,828 | 6/1969 | Bielstein . | |
| 3,580,207 | 5/1971 | Pangalila . | |
| 3,602,302 | 8/1971 | Khuth . | |
| 3,952,684 | 4/1976 | Ferguson et al. . | |
| 3,982,401 | 9/1976 | Loggins . | |
| 4,102,288 | 7/1978 | Berry et al. | 405/217 X |
| 4,301,760 | 11/1981 | Cassone et al. . | |
| 4,352,599 | 10/1982 | Goldsmith . | |
| 4,462,717 | 7/1984 | Falcimaigne . | |
| 4,470,721 | 9/1984 | Shotbolt . | |
| 4,606,673 | 8/1986 | Daniell . | |
| 4,630,681 | 12/1986 | Iwamoto . | |
| 4,643,614 | 2/1987 | Laursen . | |
| 4,702,321 | 10/1987 | Horton . | |
| 4,936,710 | 6/1990 | Petty et al. . | |
| 4,966,495 | 10/1990 | Goldman . | |
| 4,983,073 | 1/1991 | Petty et al. . | |
| 5,135,327 | 8/1992 | White et al. . | |
| 5,147,148 | 9/1992 | White et al. | 405/224.2 X |
| 5,150,987 | 9/1992 | White et al. . | |
| 5,190,411 | 3/1993 | Huete et al. | 405/223.1 |

*Primary Examiner*—David H. Corbin
*Attorney, Agent, or Firm*—M. Kathryn Braquet Tsirigotis

[57] ABSTRACT

A floating production and storage facility (FPS) or "floating atoll" comprises a very large tension leg platform (TLP) having a regular or irregular polygonal horizontal cross-section (including a circle) and having a centralized opening (moonpool) therethrough. The floater has wave transparent attributes, stanchions sited interior of the moonpool adapted to receive risers and maintain the risers within a limited horizontal zone with reference to the vessel while allowing vertical freedom of motion with reference to the vessel. It also has risers sited in the stanchions and connected to the bottom of the body of water upon which the TLP floats. The risers have sufficient buoyancy means below but near the surface of the water to tension the risers into vertical position, and can have additional buoyancy means distributed over much of their length. The floater can have large oil storage means, and can be moored by lateral mooring as well as the TLP tendons.

10 Claims, 4 Drawing Sheets 3
21
A
40
1
13
17
18
4
12
15
10
19
8
5
7
6
11
A 119
130
101
103
110
103
107
132
108
131
B
113
122
105
121
B
117
106
112
112
106
106
133
133
115
115
104

FLOATING PRODUCTION AND STORAGE FACILITY

TECHNICAL FIELD

This invention relates to the art of floating offshore structures, drilling, and production; and more particularly to a moored, floating platform and well system for deep water offshore hydrocarbon production.

BACKGROUND OF THE INVENTION

With depletion of hydrocarbon reserves found onshore, production of oil and gas from reservoirs underlying water has received considerable attention. In relatively shallow water, wells may be drilled in the ocean floor from bottom founded, fixed platforms. Because of the large size of the structure needed to support drilling and production facilities in deep water, bottom founded structures are limited to water depths of less than about 1,000–1,200 feet. In deeper water, floating systems have been used in order to reduce the size, weight, and cost of deep water drilling and production structures. Ship shaped drill ships and semi-submersible buoyant platforms are commonly used for such floating facilities.

When a floating facility is chosen for deep water use, motions of the vessel must be considered, and if possible, constrained or compensated for in order to provide a stable structure from which to carry on drilling and production operations. Rotational vessel motions of pitch, roll, and yaw involve various rotational movements of the vessel around a particular vessel axis passing through the center of gravity. Thus, yaw motions result from a rotation of a vessel around a vertically oriented axis passing through the center of gravity. In a similar manner, for ship shaped vessels, roll results from rotation of the vessel around the longitudinal (fore and aft) axis passing through the center of gravity and causing a side to side roll of the vessel. Pitch results from rotation of the vessel around a lateral (side to side) axis passing through the center of gravity causing the bow and stern to move alternatively up and down. With a symmetrical or substantially symmetrical platform such as a common semi-submersible, the horizontally oriented pitch and roll axes are essentially arbitrary and, for the purposes of this disclosure, such rotations about a horizontal axes will be referred to as pitch/roll motions.

All of the above vessel motions are considered only relative to the center of gravity of the vessel itself. In addition, translational platform motions must be considered which result in displacement of the entire vessel relative to a fixed point, such as a subsea wellhead. These motions are heave, surge, and sway. Heave motions involve vertical translation of the vessel up and down relative to a fixed point along a vertically oriented axis passing through the center of gravity (bobbing). For ship shaped vessels, surge motions involve horizontal translation of the vessel along a fore and aft oriented axis passing through the center of gravity. In a similar manner, sway motions involve the lateral horizontal translations of the vessel along a left to right axis passing through the center of gravity. As with the horizontal rotational platform motions discussed above, the horizontal translational motions (surge and sway) in a symmetrical or substantially symmetrical vessel such as a semi-submersible are essentially arbitrary. In the context of this specification, all horizontal translational vessel motions are referred to as surge/sway motions.

Combinations of the above described motions encompass platform behavior as a rigid body in 6 degrees of freedom. The six components of motion result as responses to continually varying harmonic wave forces. These wave forces first vary at the dominant frequencies of the wave train. Vessel responses in the six modes of freedom at frequencies corresponding to the primary periods characterizing the wave trains are termed "first order" motions. In addition, a variable wave train generates forces on the vessel at frequencies resulting from sums and differences of the primary wave frequencies. These are secondary forces and corresponding vessel responses are called "second order" motions.

A completely rigid structure fixed to the sea floor is completely restrained against response to the wave forces. An elastic structure, that is, elastically attached to the sea floor, will exhibit degrees of response that vary according to the stiffness of the structure itself and according to the stiffness of its attachment to the earth at the sea floor. A "compliant" offshore structure is usually referred to as a structure that has no stiffness relative to one or more of the response modes and that can be excited by first or second order wave forces.

Floating production or drilling vessels have essentially unrestricted response to first order forces. However, to maintain a relatively steady proximity to a point on the sea floor, they are compliantly restrained against large horizontal excursions by a passive spread anchor mooring system or by an active controlled-thruster dynamic positioning system. These positioning systems can also be used to prevent large, low frequency (i.e., second order) yawing responses.

While both ship shaped vessels and conventional semi-submersibles are allowed to freely respond to first order wave forces, they do exhibit very different response characteristics. The semi-submersible designer is able to achieve considerably reduced motion response by (1) properly distributing buoyant hull volume between columns and deeply submerged pontoon structures (2) optimally arranging and separating surface piercing stability columns and (3) properly distributing platform mass. Proven principles for these design tasks allow the designer to achieve a high degree of wave force cancellation such that motion can be effectively reduced over selective frequency ranges. Put another way, the vessel can be designed such that it has "wave transparent" attributes.

The design practices for optimizing semi-submersible dynamic performance depend primarily on "detuning" and wave force cancellation to limit heave. Pitch/roll responses are kept to acceptable levels by providing large separation distances between the corner stability columns while maintaining relatively long natural periods for pitch/roll modes. This practice keeps the pitch/roll modal frequencies well away from the frequencies of first order wave excitation and is, thus, referred to as "detuning," or sometimes "tuning." Another way to achieve acceptable hydrodynamic performance is to practice "wave force cancellation." Wave force cancellation is achieved by properly distributing submerged volumes comprising the hull relative to the elements that penetrate the water surface. Design practice to minimize platform response in various seas may involve both "detuning" and "wave force cancellation," and these techniques are well known to those skilled in the art.

Another class of compliant floating structure is moored by a vertical tension leg mooring system. This tension leg mooring provides compliant restraint of first and second order horizontal motions. In addition, such a structure stiffly restrains vertical first and second order responses of heave and pitch/roll. This form of mooring restraint would normally not be practical to apply to a conventional ship shaped monohull due to the wave force distribution and resultant response characteristics. Therefore, the vertical tension leg mooring system is generally conceived to apply to semi-submersible hull forms which can mitigate total resultant wave forces and responses to levels that can be effectively and safely restrained by stiffly elastic tension legs.

This type of floating facility, which has gained considerable attention recently, is the so-called tension leg platform (TLP). The upper terminations of vertical tension legs are located to or within the corner columns of the semi-submersible platform structure. Alternatively, the vertical tension legs can be located in a symmetrical array at the outer periphery of a torus shaped floating structure. The tension legs are maintained in tension at all times by insuring that the buoyancy of the TLP exceeds its operating weight under all environmental conditions. Put another way, the tendons must be under sufficient tension that no tendon will go slack in a design storm, usually a one hundred year storm. When the buoyant force of the water displaced by the platform/structure at a given draft exceeds the weight of the platform/structure (and all its internal contents, payloads, riser tensions, etc.), there is a resultant "excess buoyant force" that is carried as the vertical component of tension in the mooring elements (and risers in the case of conventional TLP). When stiffly elastic continuous tension leg elements (tendons) are attached between a rigid sea floor foundation and the corners of the floating hull, they effectively restrain vertical motion due to both heave and pitch/roll inducing forces while there is a compliant restraint of movements in the horizontal plane (surge/sway and yaw). Thus, a tension leg platform provides a very stable floating offshore structure for supporting equipment and carrying out functions related to oil production. Conoco's Hutton platform in the North Sea is the first commercial example of a TLP. Saga's Snorre platform recently installed in the North Sea is a current example of a TLP.

The primary interest in the TLP concept is that the stiff restraint of vertical motion makes it possible to tie back wells drilled into the sea floor to production facilities on the surface through a collection of pressure containment apparatuses (e.g., the valves of a well "tree") such that the "christmas tree" is located above the body of water within the dry confines of the platform's well bay. This "dry tree" concept is very attractive for oil field development because it allows direct access to wells for maintenance and workover. As water depth (and thus tendon length) increases, tendons of a given material and cross section become less stiff and less effective for restraining vertical motions. In other words, they become "springy." To maintain acceptable stiffness, the cross sectional area must be increased in proportion to increasing water depth. For installations in very deep water, a tension leg platform must become larger and more complex in order to support a plurality of extremely long and increasingly heavy risers and tension legs and/or the tension legs themselves must incorporate some type of buoyancy to reduce their weight relative to the floating platform. Such considerations add significantly to the cost of a deep water TLP installation. Conoco's Jolliet TLWP (tension leg well platform) in the Gulf of Mexico addresses this problem by limiting payload on the platform and by using large diameter steel pipes that are nearly buoyant as tendons. However, this approach is largely limited to locations that have sites relatively near by for the production equipment.

In the conventional TLP, the risers are connected to the TLP by riser tensions which are expensive, and because they contain various moving parts, are subject to mechanical wear and breakdown. Additionally, the risers constitute "parasitic" weight on the conventional TLP. Particularly, in deep water this increase in weight leads to larger and larger minimum hull displacements. As in air craft and motor vehicle design, there is a multiplying effect. That is, each unit of additional payload weight (or tension) requires additional structural weight to support it which in return requires still more weight or mass of the structure. Thus, any decrease in payload leads to considerable savings in the TLP structure.

Prior art references having particular relevance to the invention at hand include the following:

U.S. Pat. No. 3,111,692 discloses a floating doughnut or torus shaped platform. However, it is not a TLP and does not have risers with top buoyancy in stanchions around the periphery of the moonpool.

U.S. Pat. No. 4,702,321 is perhaps the closest of the prior art references at hand. It discloses a spar buoy vessel having risers with buoyant means held in a top and bottom frame such that the floater is free to move vertically with respect the risers. The spar buoy configuration is known to be one means of imparting wave transparency to a floater. However, the floater is not a TLP and is free to heave. Furthermore, removing the weight of the risers from the floater does not lead to the large savings of reducing parasitic weight which is effected according to the invention at hand. In other words, only the buoyancy needed to hold up the risers is reduced, not the multiplying effect which results from reducing parasitic weight on a TLP.

U.S. Pat. No. 4,983,073 discloses a large floater which has wave transparent attributes. It is largely cumulative to U.S. Pat. No. 3,111,692 in exemplifying the state of the art in this regard.

U.S. Pat. No. 4,966,495 supplemented by U.S. Pat. No. 4,606,673 disclose a constant tension buoy for wellheads in a "moonpool" of a semi-submersible shaped floater moored in a lateral fashion. All of the risers are rigidly connected and integral with the constant tension buoy which functions like a mini TLP in the passageway of the floater involved, a semi-submersible shaped floater in the case of U.S. Pat. No. 4,966,495 and a spar buoy shaped floater in the case of U.S. Pat. No. 4,606,673. The spar buoy configuration as well as the semi-submersible configuration are known to have wave transparent attributes. In neither of these references is there any suggestion of tethering the floater down to constitute a TLP. These references are also related to the COBRAS concept disclosed in *Ocean Industry*, March 1976, pages 67–69. In the COBRAS concept, the risers are connected to a riser buoyancy chamber below the platform which functions as a "false seabed" enabling access to the risers from a floater which is moored overhead. The concept of U.S. Pat. No. 4,966,495 is also disclosed in *Ocean Industry*, April/May 1991, pages 75, 77 in that a wellhead deck is fixed to risers, both it and the risers having buoyancy functioning similar to a TLP inside the "moonpool" of a floater which is moored in place. The floater, however, is not suggested to be tethered down to constitute a TLP.

The searcher in an earlier pre-examination search also cited the following references: U.S. Pat. Nos. 3,602,302;. 3,407,768; 3,256,936; 3,327,780; 3,461,828; 3,580,207; 3,952,684; 3,982,401; 4,301,760; 4,352,599; 4,462,717; 4,470,721; 4,630,681; and 4,936,710. These references appear exemplary of the state of the art.

There continues to be a compelling need for improved platforms and drilling systems, particularly those which are less costly and safer for production of hydrocarbons from beneath very deep water, particularly water depths of 500 feet to 8,000 feet and more particularly 1,000 to 4,000 feet. Unless this need is satisfied, only very rich reservoirs will support development at such relatively great depths. Therefore, it is appropriate to examine all aspects of deep water drilling and production systems in order to identify those features which are most sensitive to increasing water depths.

As water depth increases, the risers become naturally longer just as the tendons do, as discussed above. With conventional TLPs, to achieve proper top end support so as to limit riser responses in severe metocean conditions, riser top tension must be increased at a greater rate than the rate by which water depth is increased. Therefore, risers and riser tensions tend to place an ever increasing load on the floating (TLP) structures as they are placed in deeper waters. The invention at hand greatly mitigates the multiplying effect of building larger and larger hulls to support parasitic riser weight by, in effect, making each riser a mini single well TLP and placing it in a horizontal restraint means such as a stanchion in the protected moonpool of a large floating mother TLP, which can also have auxiliary moorings. The solution to a problem faced by the art effected thereby may be more fully understood in accordance with the disclosure of this application which follows:

SUMMARY OF THE INVENTION

The present invention provides a deep water drilling and production facility of considerably reduced complexity and costs, with improved safety. More particularly, the risers are sited within a large moonpool of a tension leg platform within horizontal restraints such as stanchions. The horizontal restraint means keep the tops of the risers in lateral place but provide no support for the risers. Support is provided by buoyancy means generally below but near the surface of the water such as to tension the risers into vertical position. Each riser can be thought of as a mini single leg TLP stanchioned within the "mother" TLP. The "mother" TLP in one preferred embodiment has a sheltering means for sheltering risers in stanchions in the moonpool from wind and waves. The mother TLP can also be laterally moored in addition to being tethered down as a TLP. The floating production and storage facility (FPS) of the invention can also be thought of as a sort of "floating atoll" which provides a sheltered lagoon for tending and "mothering" the self buoyed risers within their stanchions or other horizontal restraints.

More particularly, in accordance with the invention, a vessel floating on a body of water having a bottom for recovering hydrocarbons from a reservoir beneath the bottom has a regular or irregular polygonal horizontal cross section (including a circle) and has a centralized opening (moonpool) therethrough. The vessel has hydrodynamic response management attributes. The vessel has stanchions or other horizontal restraint means sited interior of the moonpool adapted to receive risers and maintain the risers within a limited horizontal zone with reference to the vessel while allowing vertical freedom of motion with reference to the vessel. The vessel has the risers sited in the stanchions or other horizontal restraint means, the risers being connected to the bottom of the body of water. The risers have sufficient buoyancy means below but near the surface of the water to tension the risers into vertical position. The vessel has one or more tendons vertically connecting it to the bottom of the body of water under sufficient tension that no tendon will go slack in a design storm. The vessel in one preferred embodiment has large oil storage means therein. The vessel in another preferred embodiment has a sheltering means for sheltering the moonpool area having the upper ends of the risers and stanchions therein. In another preferred embodiment, the vessel is also laterally moored to the bottom of the body of water, as by means of catenary, clump weight or spring buoy moorings, in addition to the tendons.

BRIEF DESCRIPTION OF THE DRAWINGS

The objects of the invention will be apparent from the following description taken in conjunction with the drawings which form a part of this specification. A brief description of the drawings follows.

DETAILED DESCRIPTION OF THE INVENTION

Figure 1:
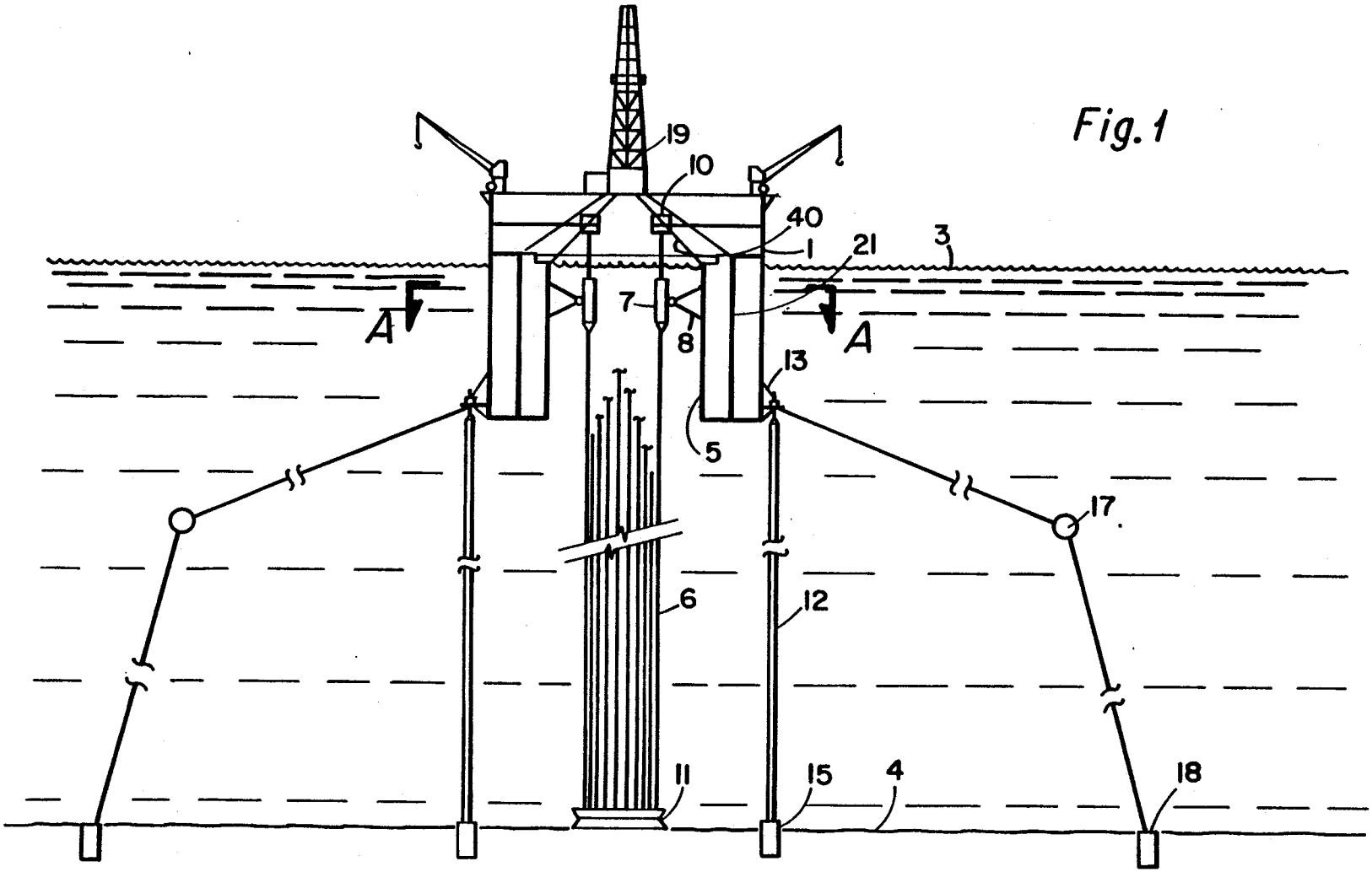
FIG. 1 is a simplified semi-schematic cross-sectional side view of a polygonal (24 sided) configuration of the invention having three mooring porches.
Figure 2:
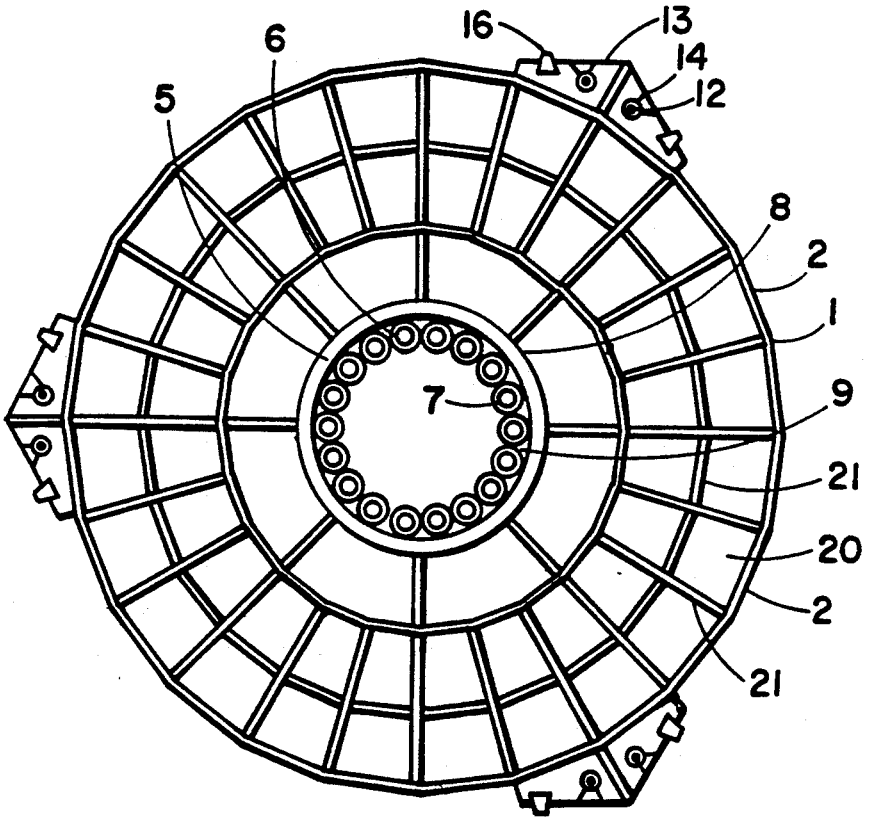
FIG. 2 is a top down view in semi-schematic and simplified format of the structure of FIG. 1 along Section A—A.

FIGS. 1 and 2 show in simplified format a polygonal (24 sided) configuration of the invention having three mooring porches. Thus, a floating structure 1 has 24 sides 2 and floats upon body of water 3 having bottom 4. The floating vessel 1 has a large moonpool 5 and framework 8 having stanchions 9 for risers 6 sited therein. The risers 6 have floatation means 7 below but near the surface of the water 3 to tension the risers into vertical position. Particularly in deep water the risers can also have flotation means extending downward along their length to lower stresses and avoid the need for very large flotation means 7 near the surface of the water. The risers are horizontally secured in stanchions 9 sited around the periphery of the framework 8 in the moonpool 5, and are free to move vertically but not horizontally because of the restraint of the stanchions. Each riser is in fluid communication from a tree 10 to a production formation (not shown) below the bottom 4 and is connected to the bottom 4 of the body of water 3 by means of a template 11 or alternately to subsea wellheads spaced at desired locations on the sea floor.

The vessel 1 is tethered to the bottom 4 of the body of water 3 under sufficient tension that no tether will go slack in a design storm by means of tendons 12, connected to porches 13, by way of connecting slots 14 and to the bottom 4 by way of anchoring means 15. Lateral motions of the vessel can also be restricted by spring buoy lateral mooring means 17 connected to porches 13 by way of connecting points 16 and to the sea floor 4 by anchoring means 18.

The vessel can also have derrick 19 which can be employed to drill wells below the sea floor 4 by way of risers 6. For example, the derrick can be mounted on a turret so as to come above each of the risers in succession or each riser can be simply moved from its stanchion to be positioned below a centrally fixed derrick by means of suitable apparatus or lines 40.

The large hull of the vessel 1 surrounding the moonpool 5 has numerous cells 20 bounded by bulkheads 21 which are suitable for storing large quantities of crude oil and/or ballast. As is shown in the drawings, the area in the moonpool is well sheltered from waves, wind, and/or current by the configuration of the vessel 1.

Figure 3:
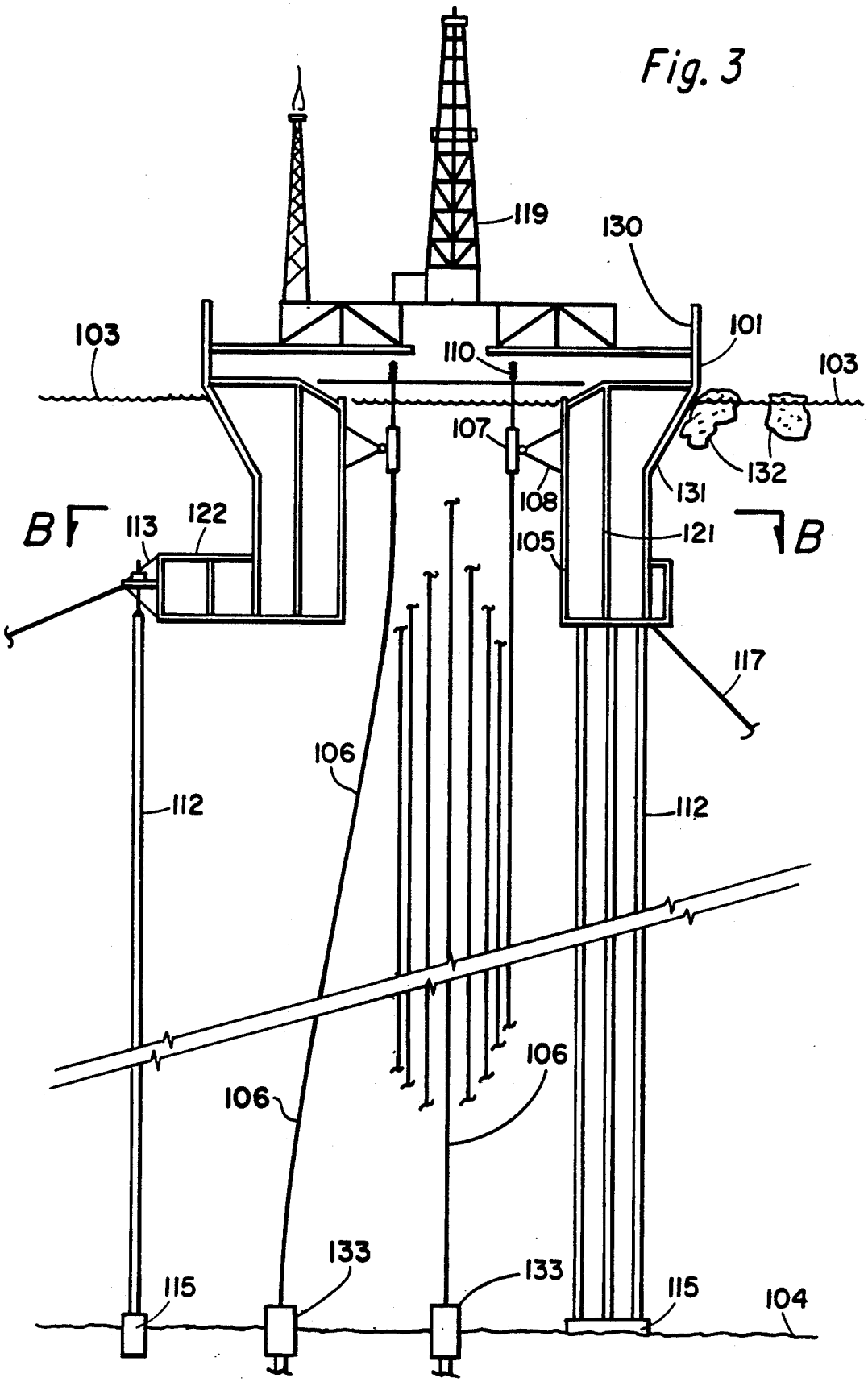
FIG. 3 is a simplified semi-schematic partial cross-sectional side view of a mode of the invention in which the vessel has a 24 sided polygonal horizontal cross-section and in which the porches are sited substantially outboard of three apexes to further suppress pitch/roll.
Figure 4:
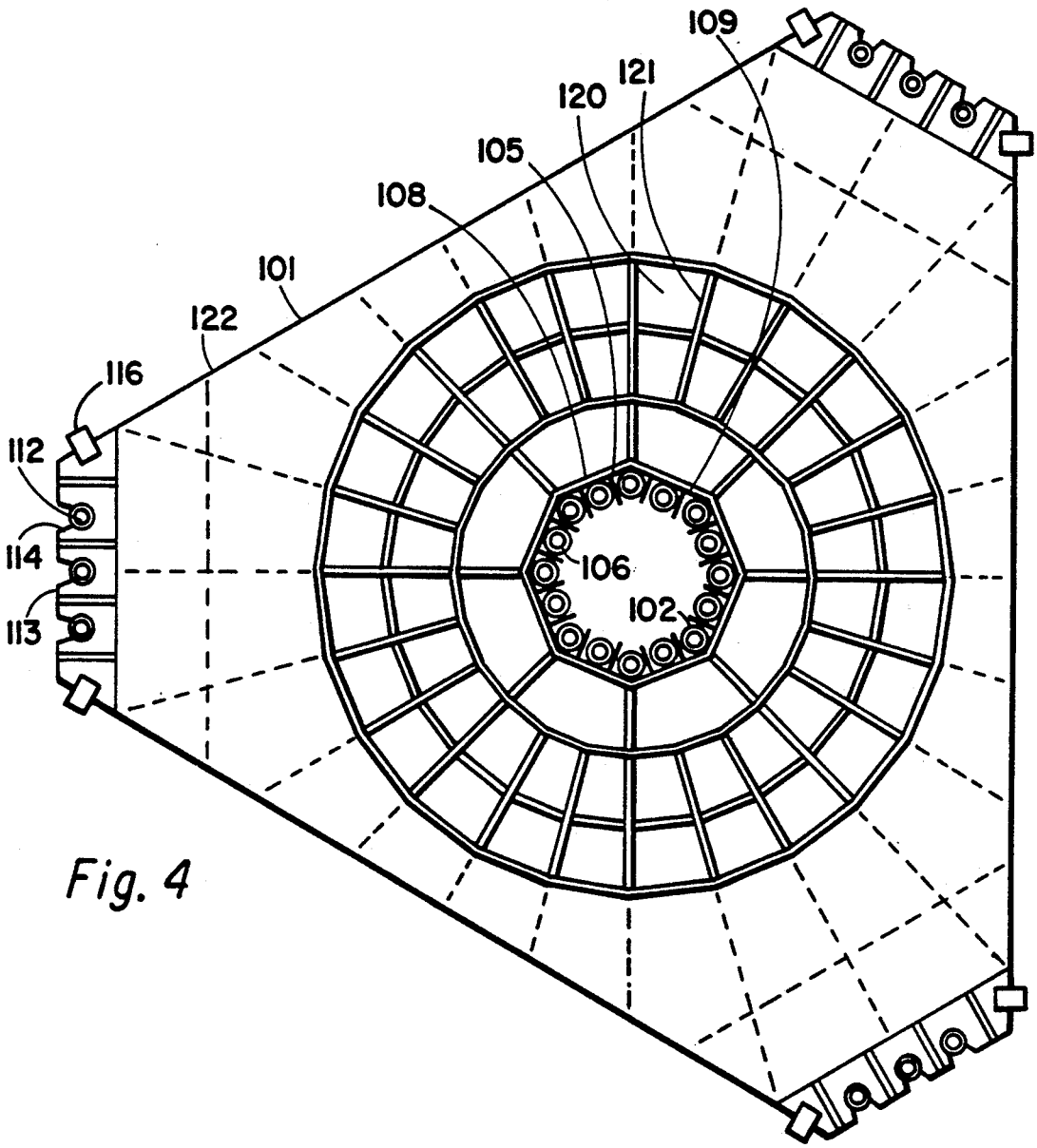
FIG. 4 is a top down view in semi-schematic and simplified format of the structure of FIG. 3 along Section B—B.

Another mode of the invention is shown in FIGS. 3 and 4. Thus, FIG. 3 is a simplified semi-schematic partial cross-sectional side view of this mode of the invention in which the vessel has a 24 sided polygonal horizontal cross-section and in which the porches are sited substantially outboard of the vessel on three apex structures to further suppress pitch/roll. FIG. 4 is a top down view in semi-schematic and simplified format of the structure of FIG. 3 along section B—B.

The features of this mode of the invention mostly correspond to features of FIG. 1 except that 100 has been added to the numerals for designation. For example, in FIG. 3, vessel 101 corresponds to vessel 1 in FIG. 1. Additional features shown on FIG. 3 not having a corresponding feature on FIG. 1 include the framework 122 at the apex of the vessel 101 which mounts the porch 113 substantially outboard of the vessel 101 so that tethers 112 better suppress pitch/roll. Also, the vessel has an ice breaking configuration which comprises downward breaking prow 131 to protect it against floating ice 132. The configuration can also comprise an upward breaking surface, taut lines extending from above the surface to below the ice level, or other means as are known to the art for ice protection. A high wind shield 130 is sited to further protect the moonpool cone in the mode of FIG. 3. Individual wellheads 133 are employed instead of template 11 to connect risers 106 to the bottom 104 of the body of water 103. The wellheads 133 can be arranged in concentric circles (as viewed from above). A large, modest draft, "raft" at the base of the floating structure enables it to be fabricated in a shallow depth harbor before being towed to sea for installation at a deeper draft. The shape of the hull in way of the water line is shown as generally conical, a geometry that enhances both the resistance to ice effects and the platform behavior in waves. The outer wellheads impart some curvature to the risers as is shown in exaggerated depiction in FIG. 3 for the riser on the left.

In FIG. 4, the outer barrier 130 functions as a sheltering means for sheltering the moonpool 105 from wind and waves, thus, forming a very calm "lagoon" within the floating "atoll" (the vessel 101).

Thus, the present invention as exemplified by the foregoing modes provides a deep water drilling and production facility of considerably reduced complexity and costs, with improved safety. A concise description of the way the invention works is provided in the foregoing Summary Of The Invention of this specification.

Those skilled in the art are familiar with other uses of the individual components of the invention described in the summary, with many manifestations of such components being known to those skilled in the art or which will readily suggest themselves to the skilled practitioner of the art.

The modes described hereinabove are to exemplify the invention for the understanding of those skilled in the art. They are not to be considered as limiting of the invention as set out in the claims and equivalents hereof.

We claim:

1. A vessel floating on a body of water having a surface and a bottom for recovering hydrocarbons from a reservoir beneath the bottom:

(a) the vessel having a regular or irregular polygonal horizontal cross-section and having a centralized opening therethrough;

(b) the vessel having wave transparent attributes;

(c) the vessel having horizontal restraint means sited interior of the centralized opening adapted to restrain the risers within a limited horizontal zone with reference to the vessel while allowing vertical freedom of motion with reference to the vessel;

(d) the vessel having the risers sited in the horizontal restraint means and connected to the bottom of the body of water, the risers having sufficient buoyancy means below but near the surface of the water to tension the risers into vertical position; and (e) the vessel having one or more tendons vertically connecting it to the bottom of the body of water under sufficient tension that no tendon will go slack in a design storm.

2. The vessel of claim 1 having large oil storage means therein, and wherein the horizontal restraint means are stanchions.

3. The vessel of claim 1 wherein a multiplicity of tendons are affixed in symmetrical array on porches outboard of the vessel and affixed in like array to the bottom of the body of water.

4. The vessel of claim 1 wherein the polygonal horizontal cross-section has at least 8 sides.

5. The vessel of claim 1 wherein the vessel has a general torus shape.

6. The vessel of claim 1 having a sheltering means for sheltering the moonpool from wind and waves.

7. The vessel of claim 1 wherein the vessel is also laterally moored to the bottom of the body of water.

8. The vessel of claim 7 wherein the lateral mooring is by means of catenary, clump weight, or spring buoy or taut-leg moorings.

9. The vessel of claim 1 wherein the vessel has ice protection means.

10. The vessel of claim 9 wherein the ice protection means is an upward breaking or downward breaking profile at the water surface.

* * * * *